US010597901B2

(12) United States Patent
Alfredsson

(10) Patent No.: US 10,597,901 B2
(45) Date of Patent: Mar. 24, 2020

(54) HANDLE ARRANGEMENT WITH AN INTERNAL LOCK

(71) Applicant: Industrilås i Nässjö Aktiebolag, Nässjö (SE)

(72) Inventor: Bengt-Åke Alfredsson, Bodafors (SE)

(73) Assignee: Industrilås i Nässjö Aktiebolag, Nässjö (SE)

( * ) Notice: Subject to any disclaimer, the term of this patent is extended or adjusted under 35 U.S.C. 154(b) by 309 days.

(21) Appl. No.: 15/525,552

(22) PCT Filed: Dec. 1, 2015

(86) PCT No.: PCT/EP2015/078142
§ 371 (c)(1),
(2) Date: May 9, 2017

(87) PCT Pub. No.: WO2016/087409
PCT Pub. Date: Jun. 9, 2016

(65) Prior Publication Data

US 2017/0370122 A1 Dec. 28, 2017

(30) Foreign Application Priority Data

Dec. 3, 2014 (EP) ..... 14196032

(51) Int. Cl.
*E05B 13/00* (2006.01)
*E05C 3/16* (2006.01)
*E05B 5/00* (2006.01)

(52) U.S. Cl.
CPC ..... *E05B 13/002* (2013.01); *E05B 5/00* (2013.01); *E05C 3/162* (2013.01)

(58) Field of Classification Search
CPC .. Y10S 292/31; Y10S 292/30; Y10T 70/5761; E05B 5/00; E05C 1/145; E05C 3/122; E05C 19/145; E05C 1/065
See application file for complete search history.

(56) References Cited

U.S. PATENT DOCUMENTS 5,820,174 A 10/1998 Parikh et al.
6,023,953 A * 2/2000 Vickers ..... E05B 5/00 292/170

(Continued)

FOREIGN PATENT DOCUMENTS

| | | |
|---|---|---|
| EP | 2518242 A2 | 10/2012 |
| FR | 2741102 A1 | 5/1997 |
| FR | 2985535 A1 | 7/2013 |

OTHER PUBLICATIONS

International Search Report and Written Opinion for International Application No. PCT/EP2015/078142, dated Aug. 2, 2016 (9 pages).

*Primary Examiner* — Mark A Williams
(74) *Attorney, Agent, or Firm* — Kagan Binder, PLLC

(57) ABSTRACT

The present invention relates to a handle arrangement (100) for arrangement to a door comprising a body (1), a handle (2) rotatably arranged to the body (1) and movable between closed and an open position, and a latch mechanism (6) for latching a door to a door frame. The latch mechanism (6) being maneuverable between a latching position and an unlatching position by rotating the handle (2) round a first rotational axis (A), The latch mechanism further comprises a lock arrangement (4) rotationally movable around its central axis (C) and comprises a moveable locking element (7) configured to be moved between an unlocked position and a locked position upon rotation of the lock arrangement (4), wherein the locking element (7) comprises a flange (8) and the handle (2) comprises a stopping surface (9), wherein said flange (8) in the locked position is configured to abut the stopping surface (9) to prevent rotation of the gripping portion (3) around said first rotational axis (A).

9 Claims, 10 Drawing Sheets

(56) References Cited

U.S. PATENT DOCUMENTS

| | | | | |
|---|---|---|---|---|
| 6,139,074 | A | 10/2000 | Barnett et al. | |
| 6,543,821 | B1 * | 4/2003 | Weinerman | E05B 13/105 292/123 |
| 8,857,230 | B1 * | 10/2014 | Misner | E05B 17/0025 292/229 |
| 2004/0074267 | A1 * | 4/2004 | Linares | E05B 5/00 70/208 |

* cited by examiner

HANDLE ARRANGEMENT WITH AN INTERNAL LOCK

CROSS-REFERENCE TO RELATED APPLICATIONS

This application claims priority to International Application No. PCT/EP2015/078142, filed Dec. 1, 2015, and titled "HANDLE ARRANGEMENT WITH AN INTERNAL LOCK", which in turn claims priority from European Application having serial number 14/196032.8, filed on Dec. 3, 2014, both of which are incorporated herein by reference in their entireties.

TECHNICAL FIELD

The present disclosure relates to a handle arrangement, and particularly to a lockable handle arrangement.

BACKGROUND

In the field of latches, there are many types of latches. Latches typically comprise a latch mechanism, and a handle arrangement which is arranged to maneuver the latch mechanism to open and close. A common type of latch is a paddle latch, which comprise a paddle handle that is grippable with several fingers, and lifts outwards relative to the door on which it is mounted, in order to open the latch. The latch mechanism may be a slidable latch or a hooking arrangement that engages in a corresponding door frame. The latch is often lockable with a lock to prevent unauthorized opening of the door. A problem with this type of latch is that the lock may be polluted with dirt and debris, and may therefore fail or cause unnecessary disturbances. Also, the lock is often located close to the gripping part of the handle as it locks the latch mechanism, and therefore the key to the lock consequently obstructs the space where the gripping part of the paddle is, since it is commonly desirable to be able to open a door without removing the key. Consequently, an improved solution of a handle arrangement with a lock is desired.

SUMMARY

It is an object of the present invention to provide an improved solution that alleviates the mentioned drawbacks with present devices. Furthermore, it is an object to provide a handle arrangement for arrangement to a door. The handle arrangement comprises a body and a handle rotatably arranged to the body and movable between a closed and an open position. The handle arrangement further comprises a latch mechanism for latching a door to a door frame. The latch mechanism is maneuverable between a latching position and an unlatching position by rotating the handle round a first rotational axis. The handle arrangement further comprises a lock arrangement which is rotationally movable around its central axis and comprises a moveable locking element configured to be moved between an unlocked position and a locked position upon rotation of the lock arrangement. The locking element comprises a flange having a bottom surface and the handle comprises a stopping surface. The flange in the locked position is configured such that the bottom surface abuts the stopping surface to prevent rotation of the gripping portion around the first rotational axis.

A handle arrangement may be configured to be arranged on a door, in order to aid opening and closing of the door.

The door may for instance be mounted on a cabinet for industrial purposes, but any usage may be possible. The door may have ha front surface and a back surface, where in the front surface is arrange to face a room in which the cabinet is placed. The handle arrangement may comprise a body having an outer surface, a back side surface, a length, a width and a depth, and which may be configured to be mounted on a door. The handle arrangement may be mounted such that the depth of the handle arrangement may be fitted in a corresponding cut out in the door, such that the back side surface is arranged towards the front surface of the door. The handle arrangement may comprise a latch mechanism, which may be arranged to prevent undesired opening of a door. The latch mechanism may be arranged to engage in a corresponding door frame. The handle arrangement may thus be mounted on the door such that the latching mechanism is placed substantially close to the edge of the door. The latch mechanism may be movable between a latched and an unlatched position, wherein the unlatched position may provide that the latch mechanism is placed to unlatch from a door frame, and subsequently allow the door to be moved open. By unlatching the latch mechanism it may allow a user to open a door, which in a closed state may be latched. The handle may be configured for a user to grip when opening and closing the door. The handle may be centrally placed on the body, and sized to comfortably fit a person's fingers. The handle may be shaped suitably. It may be straight, a paddle, a cross, curved or another suitable shape. The handle may be provided with a gripping liner in order to provide a soft comfortable grip. The handle may be rotatably arranged to the body, and the rotation may provide movement between a closed and an open position in order to unlatch the latch mechanism. The handle may be biased towards the closed position, for instance by means of a spring. The handle may be rotatable around a first rotational axis, which may be substantially parallel to the outer surface. The handle may be coupled to the body along the first rotational axis. That means that the handle may be rotatable outwards relative to the door, and that when in an open position, when a person is lifting the handle, the handle may be placed at an angle relative to the outer surface. The handle arrangement may further be lockable by a lock arrangement in order to prevent unauthorized opening of the door. The lock arrangement may be placed along a longitudinal centre line that runs along the length of the handle arrangement, and placed between a front edge of the body and the handle.

The lock arrangement may be movable between an unlocked position and a locked position. The lock arrangement may be arranged such that when in a locked position, the lock arrangement prevents the handle from being rotated, hence preventing the handle to maneuvering the latch mechanism to the unlatching position. The lock arrangement may comprise a lock element which may be jointly rotatable with the locking arrangement. The lock element may comprise a flange similarly rotatable along with the lock element. The flange may have a bottom surface, facing down towards the depth of the handle arrangement. In order to prevent the handle from being rotated, the flange may be positioned to obstruct the handle from moving. The handle may comprise a stopping surface. The stopping surface may be part of a cut out in the handle and may be placed in proximity to the lock arrangement such that when the flange is in a locked position, the bottom surface of the flange may abut the stopping surface such that the handle is prevented from moving, and subsequently prevents to open the latch mechanism. The stopping surface may alternatively be formed as a shoulder or protrusion. The stopping surface and the bottom surface of the flange may be placed substantially close to each other in order to prevent the latch mechanism to open. By arranging the lock arrangement to prevent rotation of the handle, the lock arrangement may be arranged anywhere close to the handle. Also, by allowing the lock arrangement to lock a part of the handle instead of locking the latch mechanism, the lock arrangement may be arranged anywhere suitable in connection to the handle.

By arranging the lock arrangement adjacent to the handle, away from the part where a person grips his fingers and preventing rotation of the handle rather than locking the latch mechanism itself, the lock arrangement may be placed away from the latch mechanism. This may be an advantage since a solution of this type may prevent dirt and debris to be transferred from inside the door to outside the door, through the handle arrangement. Further it may be possible to place the lock at a distance from the handle where a user would grip the handle, and subsequently avoid hitting the key upon opening of the handle.

In an embodiment of the invention, the handle further may comprise an inclined surface. The inclined surface may be configured such that when the flange is in an unlocked position, the bottom surface may be arranged opposite to the inclined surface at an angle. This may admit the handle to rotate around the first rotational axis in order to bring the latch mechanism in an unlatching position, wherein the rotation is limited by the bottom surface abutting the inclined surface.

The inclined surface may be configured such that when the handle is in a closed position, the inclined surface extends at an angle relative to the bottom surface of the flange. The inclined surface may be arranged such that when the lock arrangement is in an unlocked position, the handle may be allowed to rotate into an open position. As the handle is rotated, the inclined surface may be brought towards the flange and subsequently the bottom surface of the flange may abut the inclined surface when the handle is in an open position. The abutment between the bottom surface and the inclined surface may stop further rotation of the handle. The inclined surface may extend from below the stopping surface, which may be centrally located on a part of the handle, and directed upwards towards the front edge of the latch mechanism and sloping at an angle. The inclination of the surface may set the angle at which the handle may be rotated. Any movement further than that angle may be prevented by the flange. The angle may correspond to the inclination angle of the inclined surface relative to the bottom surface of the flange. The flange may be rotationally movable by maneuvering the lock arrangement with for instance a key around its central axis. The flange may thus be movable between a locked position, where it may abut a stopping surface, and hence preventing the handle from rotating around the first rotational axis, and an unlocked position wherein it may allow the handle to rotate at an angle until it may abut the inclined surface on the handle and thereby prevent further rotation of the handle. When the handle has been rotated such that the inclined surface abuts the flange, the inclined surface may be substantially parallel to the bottom surface of the flange. The rotation of the flange between the locked and the unlocked position may be between 5 to 180 degrees, preferably about 90 degrees.

In an embodiment of the invention, the lock arrangement is rotatable around a central axis perpendicular to the first rotational axis.

The central axis may be arranged perpendicular to the first rotational axis of the handle. The first rotational axis and the central axis may be placed at a distance from each other. Alternatively, the first rotational axis and the central axis may intersect. By placing the first rotational axis and the central axis perpendicular to each other, any forces acting upon the bottom surface of the flange upon rotation of the handle may be evenly distributed as to prevent stress concentrations in any part of the flange, and thereby prevent unnecessary breakage.

In an embodiment of the invention, the handle comprises a gripping portion, and wherein the stopping surface is arranged between the gripping portion and the first rotational axis.

A part of the handle may constitute a gripping portion, which may be a part on the handle configured for a user to grip when seizing the handle for maneuvering the latch mechanism. The gripping portion may constitute the utmost part of the handle and may be configured to provide suitable leverage on the handle. The stopping surface may be arranged on the handle between the rotational axis and the gripping portion, close to the lock arrangement. The stopping surface may be placed as close as possible to the first rotational axis. By placing the stopping surface close to the rotational axis, there may be a reduced risk that the forces acting upon the flange when a user tries to open a locked latching mechanism may break the flange, due to leverage.

In an embodiment of the invention, the body comprises a gripping portion receiving area in which the gripping portion is located in closed position.

The body may comprise a gripping portion receiving area, which may be an inwardly configured recess in the body which may be large enough to comfortably fit a user's hand when gripping the gripping portion. The gripping portion receiving area may be arranged such that it comprises an open space with an opening towards the top in the direction of the outer surface, and may be limited by material from the body under the space. The gripping portion receiving area may be substantially square to follow the shape of the handle arrangement. Alternatively, the gripping portion receiving area may be round or oval.

In an embodiment of the invention, the body comprises an internal lock cavity adjacently located to the gripping portion receiving area, in which internal lock cavity the locking element and the stopping surface are located.

The internal lock cavity may be connected to the gripping portion receiving area and located towards the lock arrangement. The internal lock cavity may be configured to house at least some of the moving parts of the lock arrangement and the part of the handle that comprises the stopping surface and the inclined surface. The internal lock cavity may be provided with a bottom surface that may serve as seclusion towards the inside of the door on which the handle arrangement is mounted.

The internal lock cavity may subsequently be arranged separate from any latching mechanisms, separated by material from the body. By placing the internal lock cavity in the body, secluded from the latching mechanism, the lock arrangement may be protected from dirt and debris arising on the other side of the door on which the handle arrangement is arranged, as well as any lubricants that may be used in the lock may be protected from soiling the latching mechanism. The cavity may also be secluded from the gripping portion receiving area.

In an embodiment of the invention, the gripping portion receiving area and the internal lock cavity are in direct fluid connection with each other.

The gripping portion receiving area may be in fluid connection with the internal lock cavity. This means that the two spaces may be included in each other, and there is no external obstruction between the spaces. By letting the gripping portion receiving area and the internal lock cavity be connected to each other, it may facilitate manufacturing of the body. Also, it may facilitate assembly of the handle arrangement.

According to an embodiment of the invention, the handle may further comprise a visor, attached to the gripping part and configured to, in a closed position, cover the lock arrangement in the internal lock cavity.

The handle may comprise a visor, which may be a piece of material arranged to cover at least a part of the lock arrangement. It may be placed between the gripping portion receiving area and the internal lock cavity in order to protect some of the moving parts within the internal lock cavity. The visor may be extending from a front part of the gripping portion downward toward the bottom of the gripping portion receiving area. The visor may be shaped as a semicircle, in order to follow the shape of the lock arrangement for providing a sleek and well shaped protection. However, it may be shaped as a straight wall or any other shape suitable. The visor may cover the lock arrangement in order to protect it from foreign particles such as dirt, dust and debris which may cause the lock arrangement to fail and subsequently break.

According to an embodiment of the invention, the body may be integrally manufactured from a single piece of material.

The body may be a solid seamless piece of material. It may be moulded, cast or machined to provide a body having a gripping portion receiving area and an internal lock cavity within the same shape. This may facilitate assembly, and it may prevent unnecessary failure.

In an embodiment of the invention, the first rotational axis extends across said internal lock cavity.

The internal lock cavity may house a number of moving parts, such as the part of the handle that is connected to the body. The handle may be rotationally connected to the body at a first rotational axis, and the first rotational axis may be extending inside and across the internal lock cavity. The rotational connection of the handle to the body may thus be placed in the internal lock cavity. By allowing the rotational connection be placed inside the internal lock cavity, the rotational connection may be protected from external dirt and debris that may cause failure.

According to an embodiment of the invention, the lock arrangement may be located on a longitudinal centre line between the gripping part and the latching mechanism.

The lock mechanism may be placed on a longitudinal centre line that runs along the centre of the body in the length direction. By placing the lock in the centre of the body, the body may be made substantially symmetrical. By making a symmetrical body, it may be similarly usable for right hand use as well as left hand use. Also, it may be more aesthetically appealing having a symmetric handle arrangement. However, it is possible to place the lock arrangement towards any of the edges along the width of the handle arrangement, since the body and the handle may be substantially modified for such use.

BRIEF DESCRIPTION OF THE DRAWINGS

The invention will in the following be described in more detail with reference to the enclosed drawings, wherein.

DETAILED DESCRIPTION OF EMBODIMENTS

Figure 1:
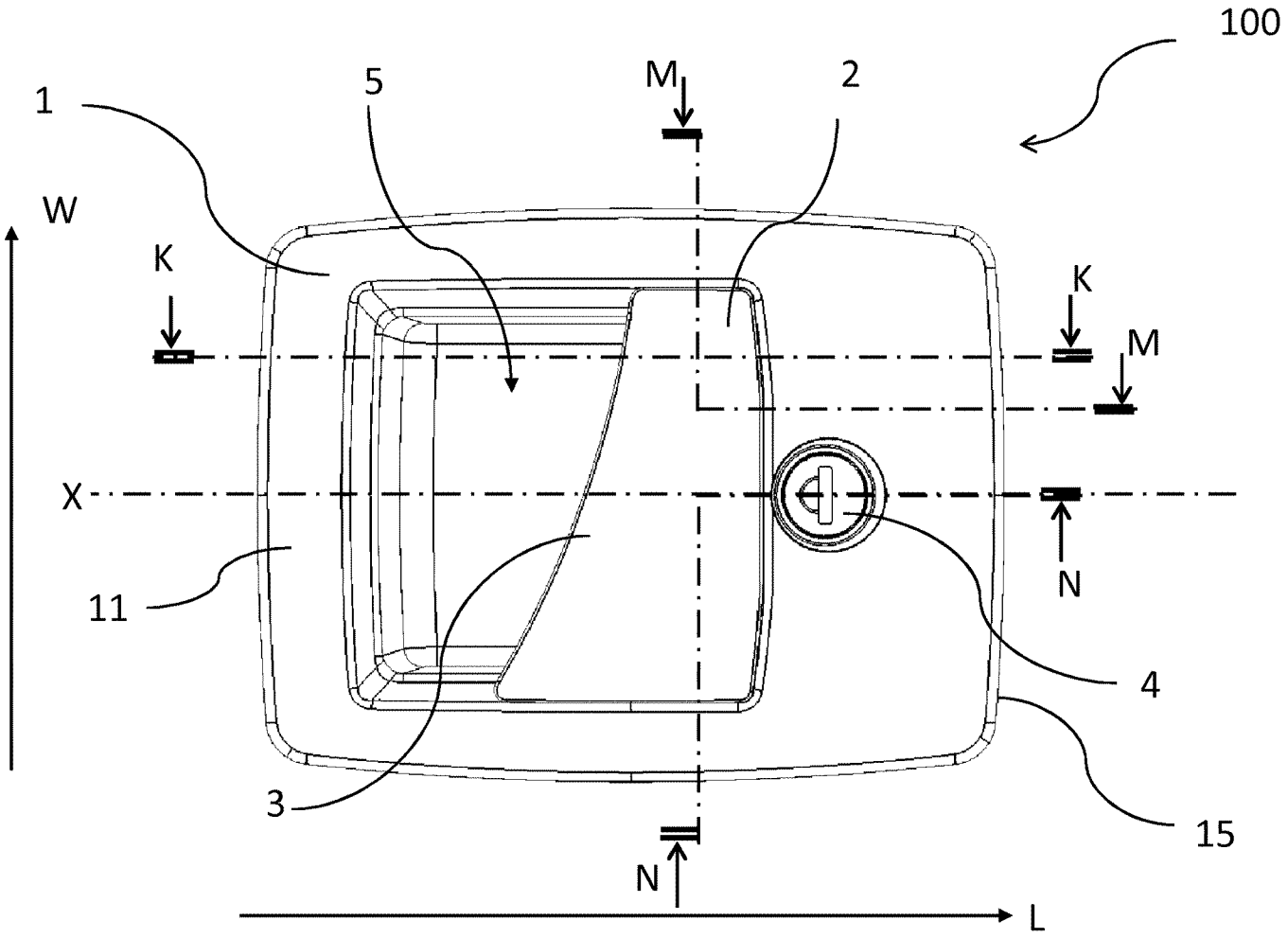
FIG. 1 is a top view of a handle arrangement according to an embodiment of the invention.

The present invention will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements.

FIG. 1 shows a top view of a handle arrangement 100. The handle arrangement 100 comprises a body 1, which is configured to be arranged on a door, such as a cabinet door or a vehicle door. The body has a length L, a width W, a depth (not shown), and an outer surface 11. The handle arrangement may, when mounted, be arranged in the same plane as the door, such that when viewing the door from the front, the handle arrangement may be substantially integrated in the door, and the outer surface 11 substantially parallel to the same plane as the door front surface. The handle arrangement 100 may be mounted with its depth arranged inside a corresponding cut out in the door. Outward is the direction on the outside of the door, which faces the room, in which the cabinet stands. The handle arrangement 100 in FIG. 1 has a handle 2. The handle 2 is located on the handle arrangement and is configured to maneuver a latching mechanism (see FIG. 2). The handle 2 comprises a gripping portion 3, which in this embodiment is slightly curved. The gripping portion 3 is the utmost part of the handle 2 where a user grips with his/her fingers for opening the door. The gripping portion may be of any shape suitable. It may be straight, curved, shaped for fingers, or similar. It may also be covered with a liner in order to provide good gripping capabilities.

The body 1 is inwardly dished in a gripping portion receiving area 5, which is arranged to fit a user's hand when gripping the gripping portion 3. The handle arrangement 100 in FIG. 1 has a lock arrangement 4 placed next to the handle 2 on the body 1. The lock arrangement 4 is placed along a longitudinal centre line X that runs across the entire length of the body 1. The lock arrangement 4 is configured to lock the handle arrangement 100 from unauthorized opening of the door. The lock arrangement 4 has a central axis C, around which it is rotatable.

The body 1 has a front edge 15. The lock arrangement 4 is located between the gripping portion 3 and the front edge 15. The lock arrangement 4 is located on the body 1 in an area separated from the gripping portion 3.

Figure 2:
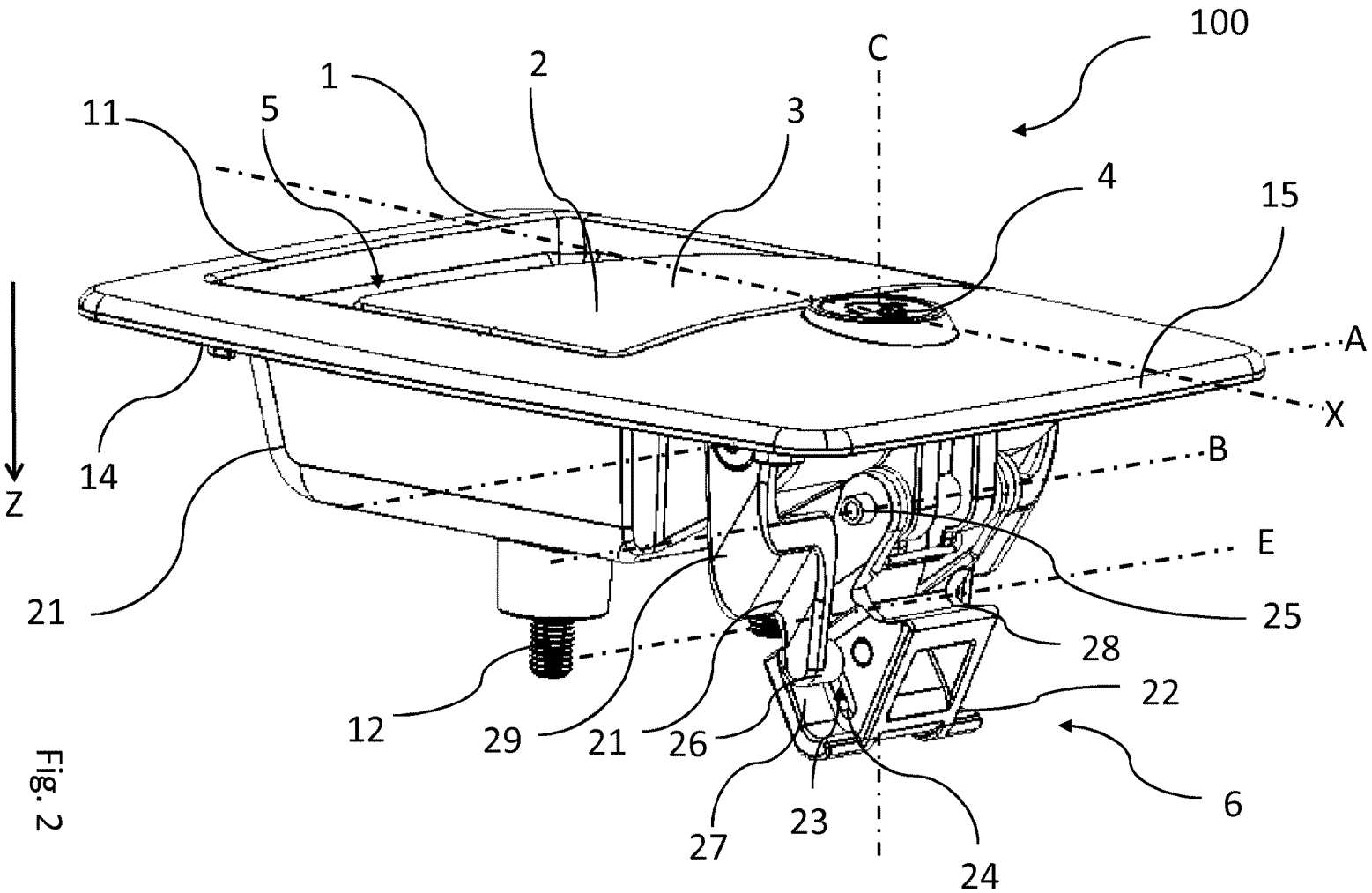
FIG. 2 is a perspective view of a handle arrangement according to an embodiment of the invention.

FIG. 2 shows a perspective view of the handle arrangement 100. Here it is shown that the body 1 has a depth in order to be mounted in a corresponding cut out in a door with fasteners 12. It is further shown a latch mechanism 6 which is configured to engage a corresponding door frame to prevent undesirable opening of the door. The latch mechanism 6 is located at the front edge 15 of the body 1.

Figure 3:
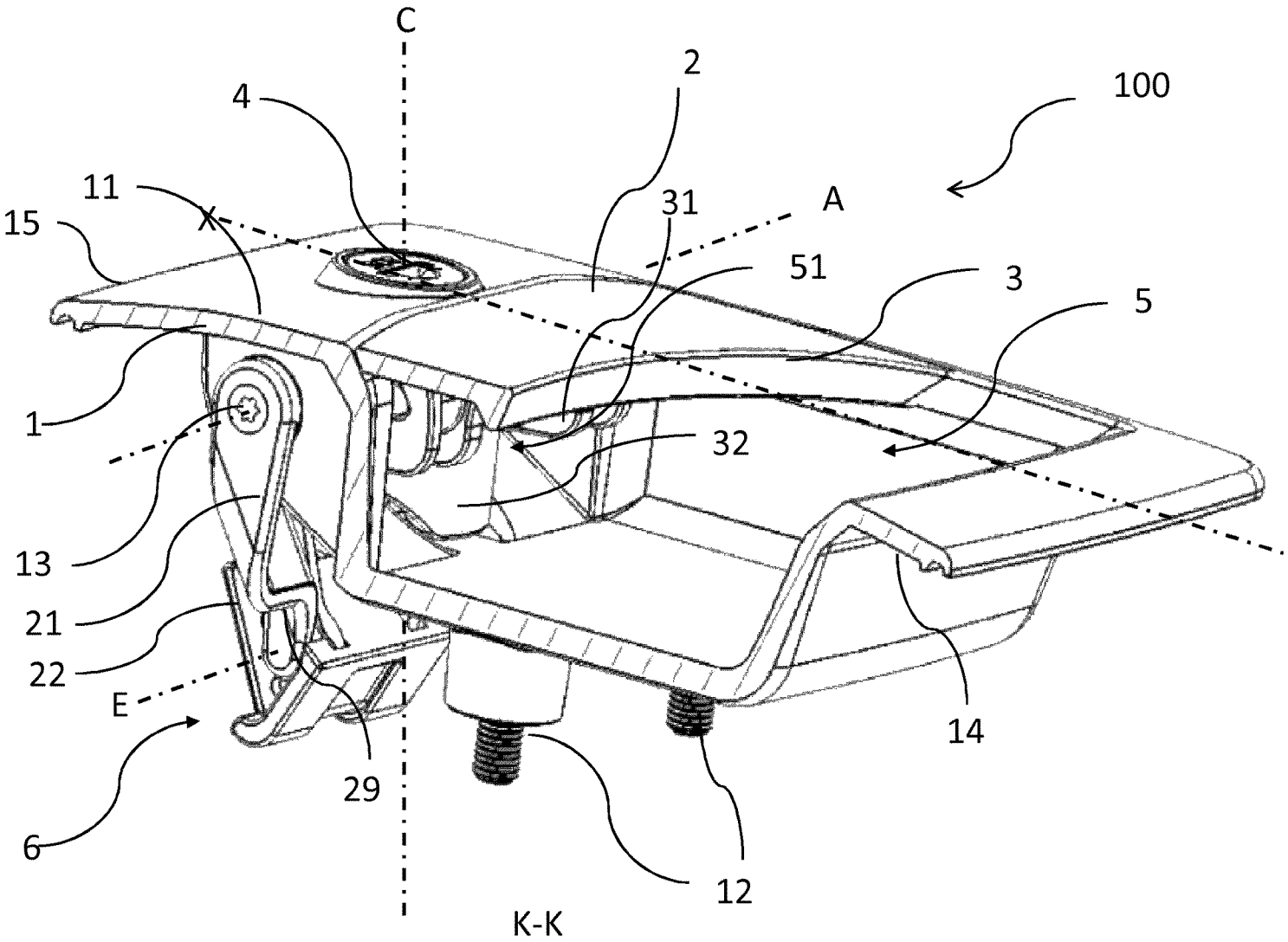
FIG. 3 is a perspective section view of a handle arrangement according to an embodiment of the invention.

FIG. 3 shows a partial section view of the internal of the body 1. FIG. 3 shows the gripping portion receiving area 5. The gripping portion receiving area 5 is a larger recess located just under the gripping portion 3 of the handle 2 when the handle 2 is in a closed position. That is when no force acts upon the handle 2 when the handle is folded down. The gripping portion receiving area 5 is connected to a smaller space, the internal lock cavity 51, which is located in the body 1 in a space that houses the lock arrangement 4. The internal lock cavity 51 is located towards the front of the handle arrangement, between the front edge 15 and the gripping portion receiving area 5. The internal lock cavity 51 houses the lock arrangement 4 and a part of the handle 2 which is connected to the body 1 via a first rotational axis A. The handle 2 is provided with arms 31 (only one is shown in FIG. 3) that extend into the internal lock cavity 51, towards the front of the body. The arms 31 are attached to the first rotational axis in order to admit rotation of the handle 2 relative to the body 1. The handle further comprises a visor 32, which provides cover for the lock arrangement 4 since the lock arrangement 4 may be caused to fail if dirt and debris contaminates the mechanism in the lock arrangement 4. The visor 32 is a static part of the handle 2 which is curved in a semicircle around the lock arrangement 4. The visor 32 may further prevent manipulation of the lock arrangement 4 when the lock arrangement 4 is in the locked position.

The latch mechanism 6 comprises a latching element 22 and a pushing element 21. In FIGS. 2 and 3, it is shown that the first rotational axis A as well provides rotation for the pushing element 21. The pushing element 21 and the handle 2 are thus coupled to each other at the rotational axis A. The handle 2 is placed inside the body 1, and the pushing element 21 is placed outside the body and connected to the body 1 in the first rotational axis A by pushing element fastener 13. The pushing element 21 is connected to the body 1 on the outside of the body 1 and is arranged to push the latching element 22 to move between an unlatched and a latched position.

Figure 4:
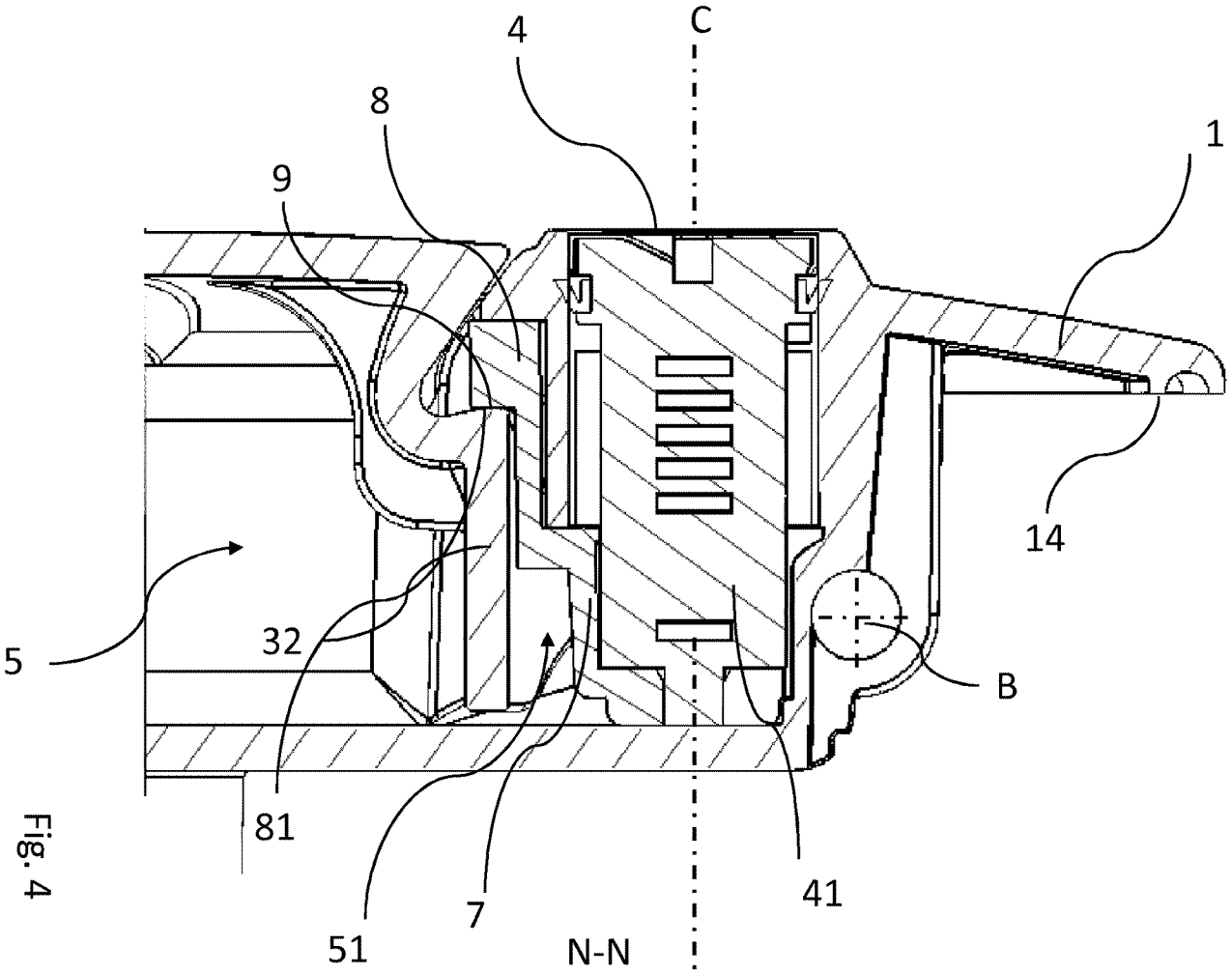
FIG. 4 is a side section view of a handle arrangement according to an embodiment of the invention.

FIG. 4 is a detailed section side view of the lock arrangement 4 and the moving parts of the handle arrangement 100 when in a locked position. The lock arrangement 4 comprises a locking cylinder 41 and a locking element 7 which is surroundingly coupled to the locking cylinder 41. When turning the locking cylinder 41 with for instance a key, the locking element 7 rotates with the locking cylinder 41. The locking element 7 comprises a flange 8 which is arranged to move as the locking cylinder 41 is turned. In FIG. 4, it is shown that the flange 8 has a bottom surface 81, and the flange 8 is placed as to abut against a stopping surface 9 which is a part of the handle 2. The flange's bottom surface's 81 position against the stopping surface 9 in FIG. 4 prevents the handle to lift, and thus move in order to maneuver the latch mechanism 6. Hence the lock arrangement 4 is in a locked position, locking the handle 2. In FIG. 4, the visor 32 is shown covering the lock arrangement when the handle 2 is in a closed position.

Figure 5:
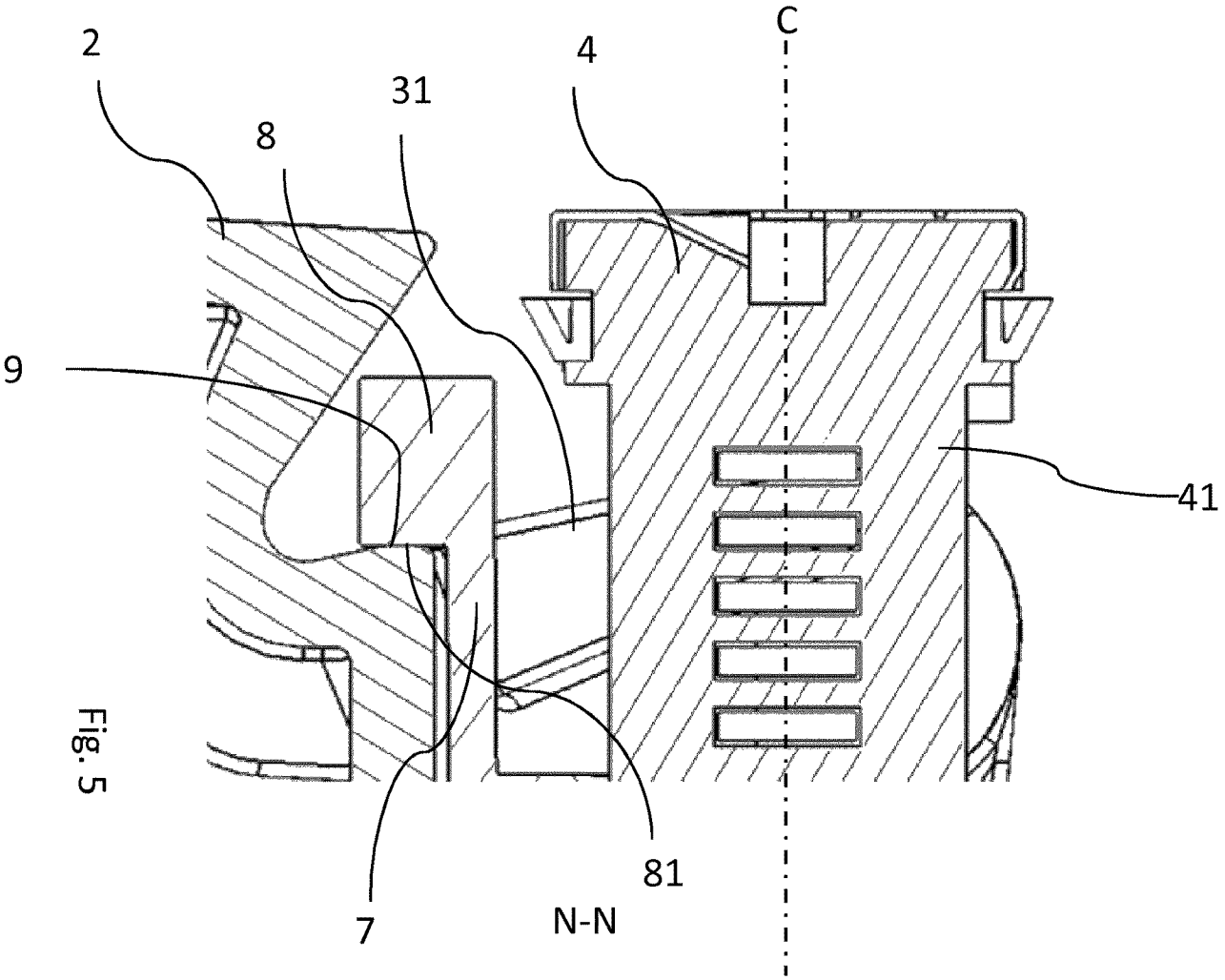
FIG. 5 is a detailed section view of a handle arrangement according to an embodiment of the invention.

FIG. 5 is a more detailed section side view of a handle arrangement 100 showing the stopping surface 9 and the flange 8 in a locked position as a bottom surface 81 of the flange 8 are in contact with each other and the handle 2 is folded down in a closed position.

Figure 6:
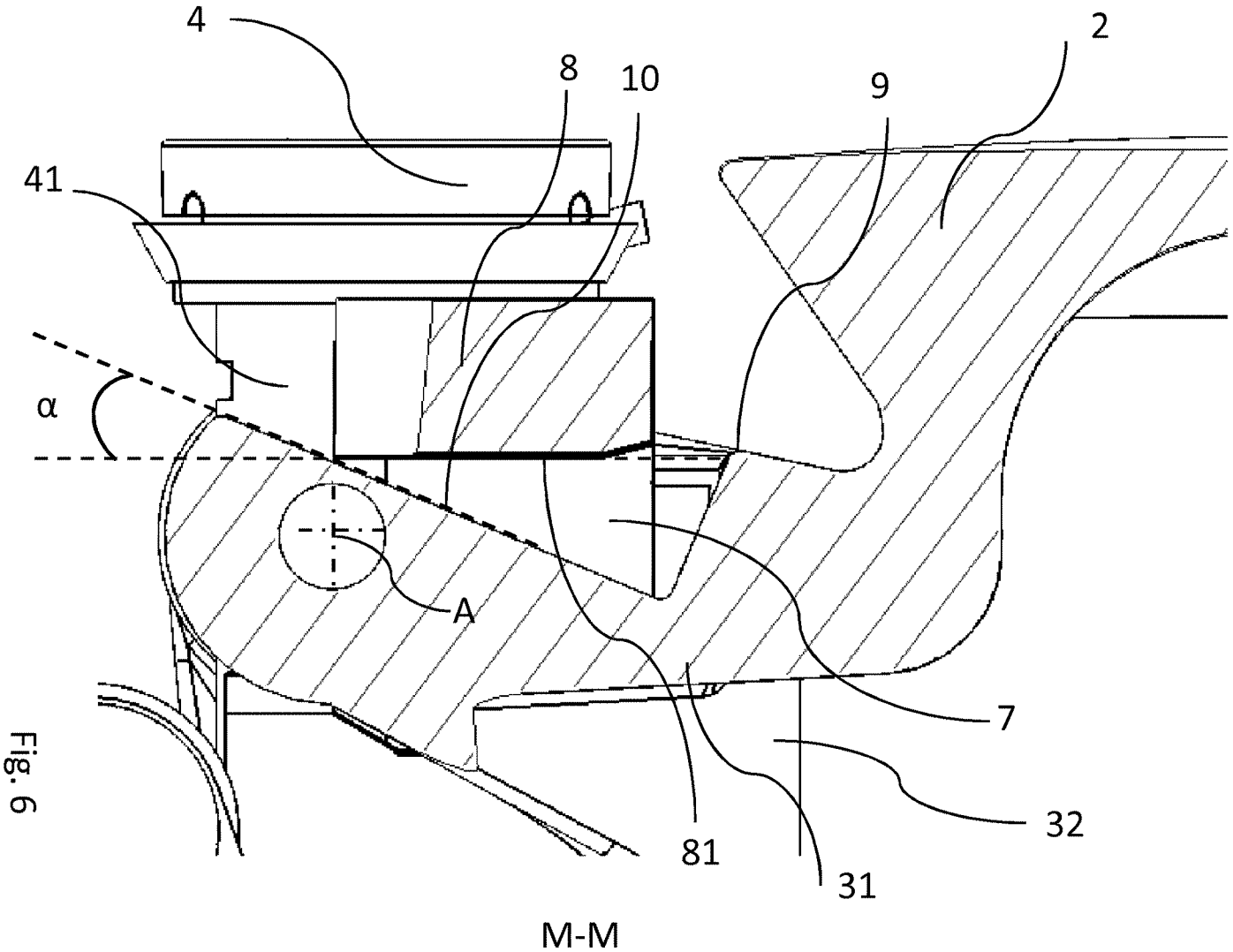
FIG. 6 is a detailed section view of a handle arrangement according to an embodiment of the invention.

In FIG. 6, it is shown a detailed side section view taken from the opposite side than of that in FIG. 5. In FIG. 6, the lock mechanism 4 is shown in an unlocked position, wherein the flange 8 is located above an inclined surface 10 of the handle 2. The lock mechanism 4 is thus turned in order to unlock the lock mechanism 4 and the bottom surface 81 of the flange 8 is instead facing towards an inclined surface 10 of the handle 2. Because of the space between the bottom side of the flange 8 and the inclined surface 10, the handle 2 can be lifted in order to unlatch the latch mechanism 6. As shown, the inclined surface 10 is set at an angle $\alpha$ which may determine the maximum rotation of the handle 2 until the inclined surface 10 abuts the flange 8. In FIG. 6, it is also shown that the handle 2 is rotationally connected around rotational axis A by an arm 31. The handle 2 comprises two arms 31. Each arm 31 located on either side of the lock arrangement 4. The arms 31 extend from the gripping portion 3 towards the rotational axis A, and the rotational axis A penetrates the arms 31, allowing the arms 31 to rotate around the rotational axis A. FIG. 6 shows the visor 32 of the handle 2 which is located between the gripping portion receiving area 5 and the internal lock cavity 51, and may serve as a cover between the gripping part receiving area 5 and the internal lock cavity 51 in order to prevent dirt and debris from entering the internal lock cavity 51.

Figure 7:
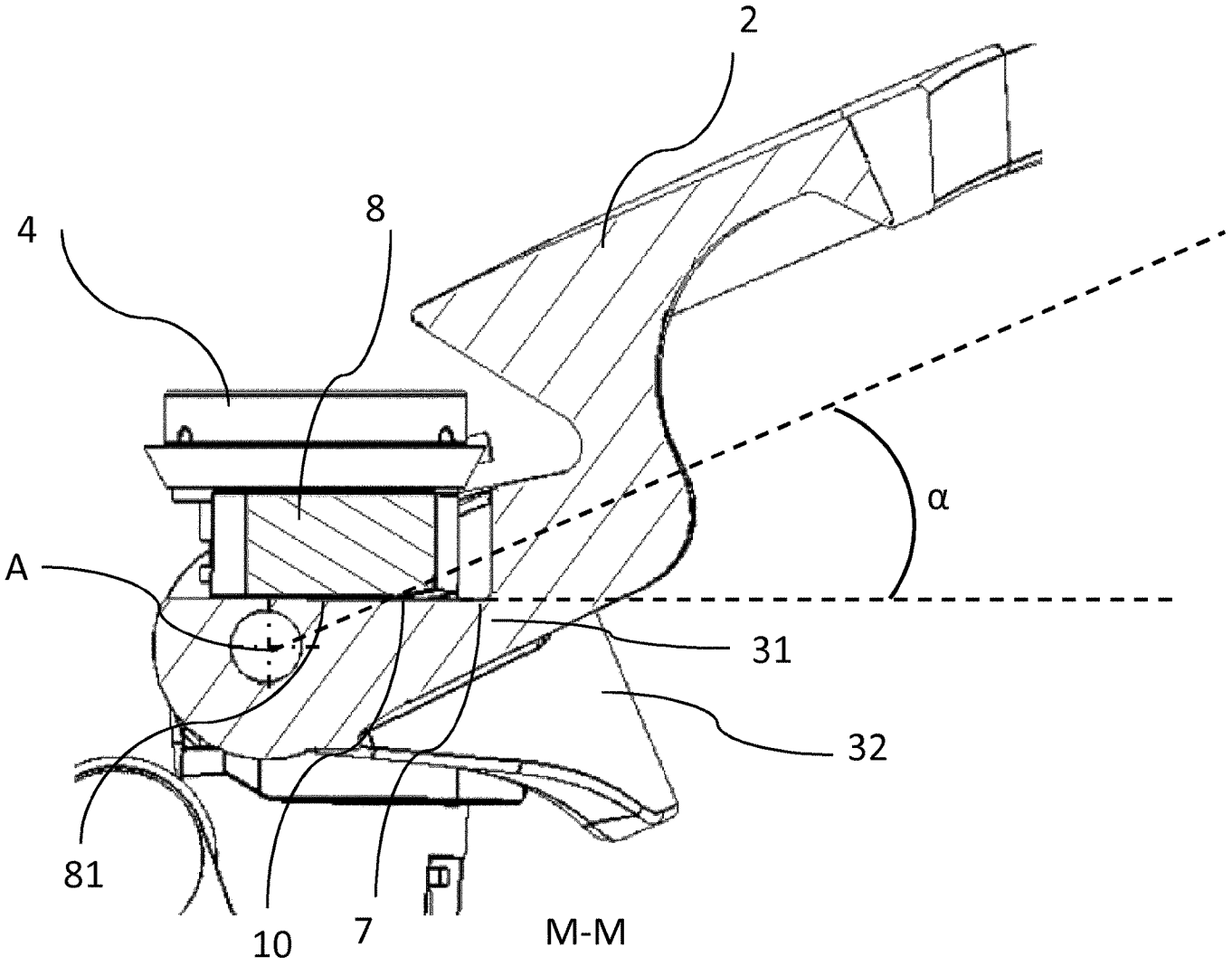
FIG. 7 is a detailed section view of a handle arrangement according to an embodiment of the invention.

FIG. 7 shows a detailed side section view of a handle arrangement 100. In FIG. 7, the handle 2 is lifted in order to unlatch the latch mechanism 6. It is shown in FIG. 7 that the handle 2 is lifted at a maximum rotation by an angle $\alpha$ since any further rotation is prevented by the bottom surface of the flange 81 hitting against the inclined surface 10.

Figure 8:
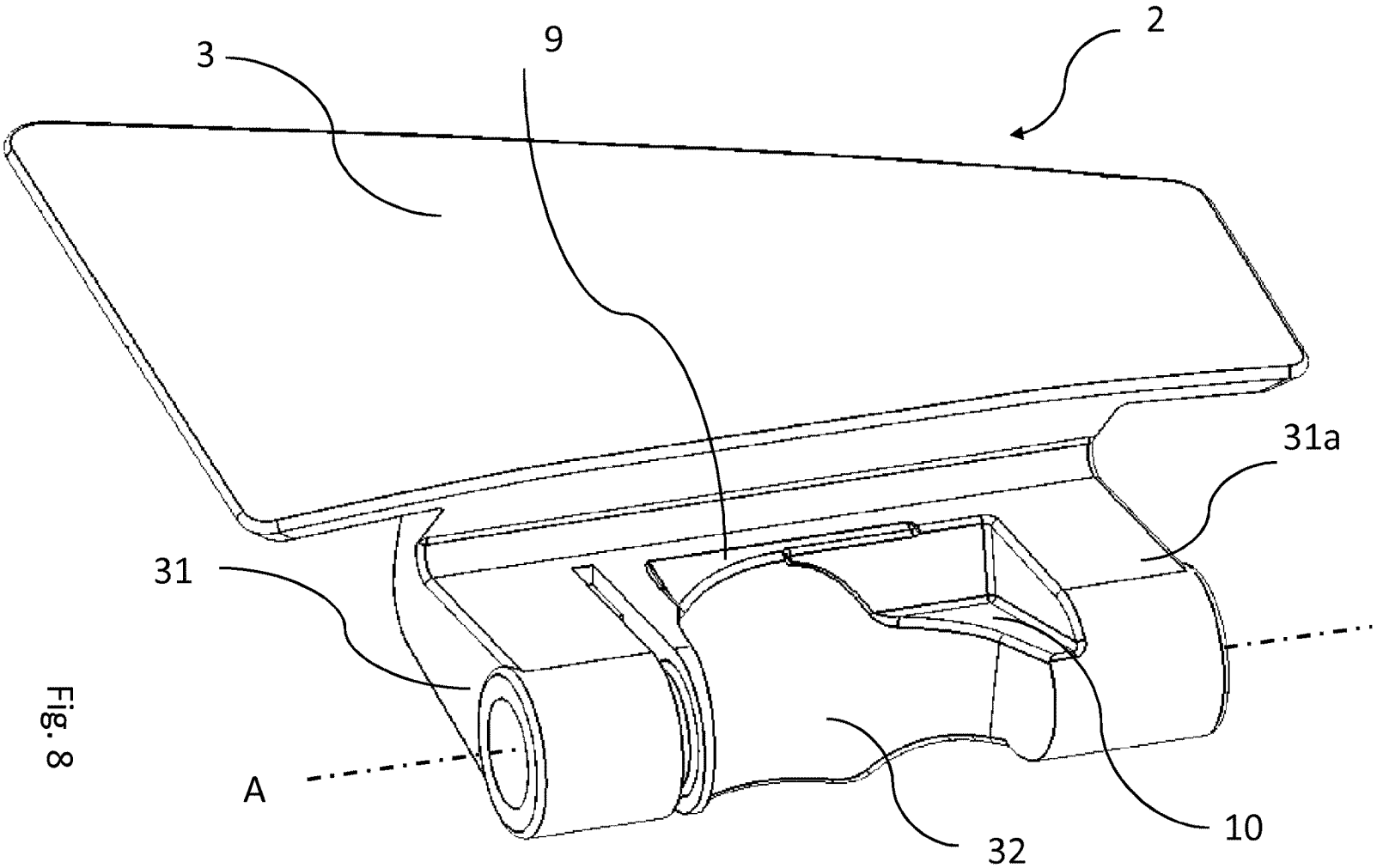
FIG. 8 is a perspective view of a single handle according to an embodiment of the invention.
Figure 10:
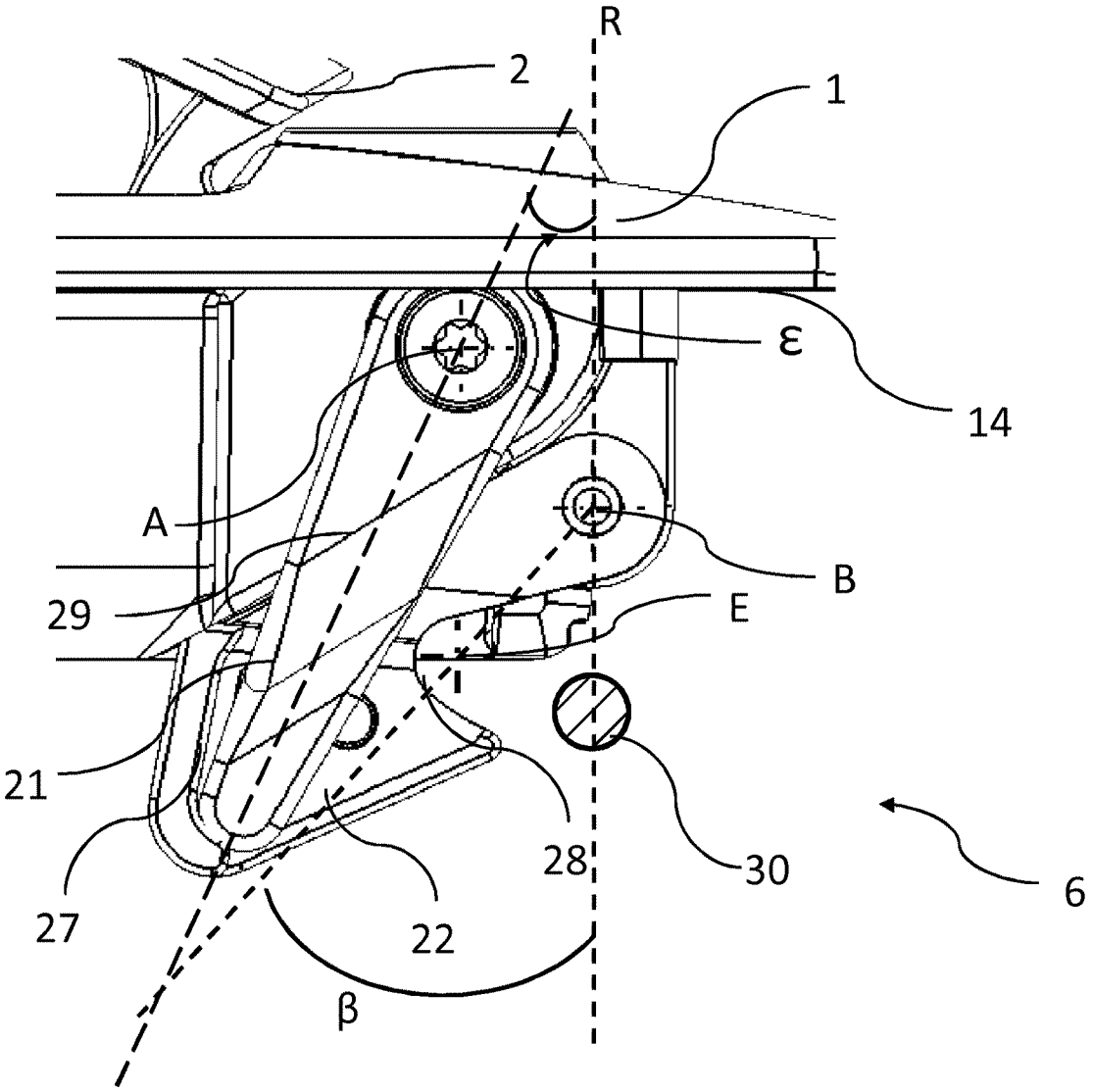
FIG. 10 is a detailed side view of a handle arrangement according to an embodiment of the invention.

In FIG. 8 a handle 2 is shown in full. It is shown that the stopping surface 9 is centrally placed on the handle 2. The stopping surface 2 is a horizontal surface located in between the arms 31, substantially flat as to allow as much contact as possible between the bottom surface 81 of the flange 8 and the stopping surface 9, when in a locked position. Further it is illustrated the location of the inclined surface 10 relative to the stopping surface 9. The inclined surface 10 is shaped as an angled recess, as shown as angle $\alpha$ in FIG. 6, in an arm 31*a*. In this embodiment, the inclined surface is placed in one of the arms 31*a*. However, in other embodiments, there may be an inclined surface in the other arm 31, or both arms, whichever may be suitable in the specific installation. In FIG. 6, the inclination extends from a point below the stopping surface 9, and extends along the arm 31*a* upwards at an angle. The angle of the inclined surface corresponds to the maximum rotation of the handle 2 around the rotational axis C, as illustrated in FIG. 10.

Figure 9:
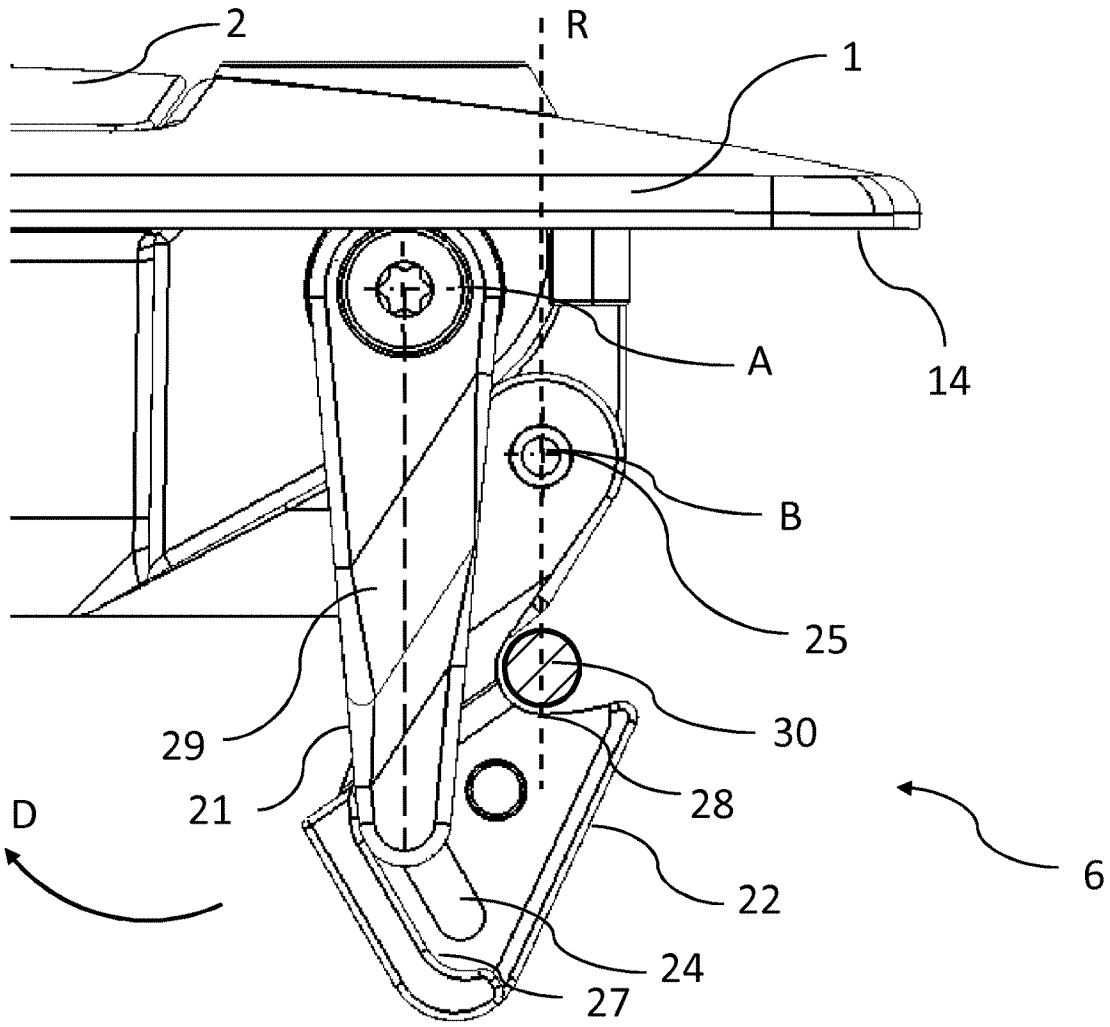
FIG. 9 is a detailed side view of a handle arrangement according to an embodiment of the invention.

As illustrated in FIG. 9, and with further reference to FIG. 2, the latching mechanism comprises a pushing element 21 and a latching element 22 is in a latching position when the latching element 22 is in latching engagement with a lock element. The lock element may be a lock pin 30 fixed to a door frame to which the door handle latching arrangement is arranged to be latched. The pushing element 21 is rotatable around the rotational axis A. The handle 2 is rotatable around the same rotational axis A. A rotation of the handle 2 causes a rotational movement of the pushing element 21.

The latching element 22 is rotatable relative to the body 1 around rotational axis B. The latching element 22 comprises a pin receiving slot 28 for receiving the lock pin 30. The latching element 22 further comprises a sliding plane 27.

The pushing element 21 comprises at least one push arm 29 extending from the rotational attachment point to the body 1 at the rotational axis A to an arm end portion at which a sliding member 26 is arranged (see FIG. 2). The sliding member 26 may be a sliding bolt 26. The pushing element 21 is via the sliding bolt 26 in slidable connection with the latching element 22. In FIG. 9 is the sliding bolt 26 in contact with the sliding surface 27 at a first position of the sliding surface 27. The pushing element 21 is rotatable in the first direction D around the rotational axis A. When rotated in the first direction D, the pushing element 21 pushes the latching element 22 from the latching position as in FIG. 9 to the open position as shown in FIG. 10.

The body 1 comprises a back side surface 14 configured to extend along an outer door surface when the handle arrangement 100 is arranged to a door. The pushing element 21 extends, when in the latching position, substantially perpendicular relative to the back side surface 14. In an embodiment wherein the pushing element 21 comprises at least one push arm 29, said at least one push arm may extend substantially perpendicular to said back side surface 14.

In FIG. 10, the latching element's 22 latching engagement with the lock pin 30 is released. Thereby is opening of a door on which the handle arrangement 100 is arranged enabled. When the pushing element 21 is rotated, by rotation of the handle 2 which causes the rotation of the pushing element 21, an accelerated rotational movement is provided to the latching element 22. This is due to the slidable connection between the pushing element 21 and the latching element 22. When the latching element 22 is in the open position as in FIG. 10, the sliding bolt 26 of the pushing element 21 is in contact at a second position of the sliding surface 27 on the latching element 22.

As seen in FIGS. 9 and 10, the pushing element 21 is rotatable an angle ε from the latching position to the open position. The handle 2 is rotatable at the same angle when rotating the pushing element 21. At the same time as the pushing element 21 has been rotated an angle ε, the latching element 22 has been rotated an angle β, wherein angle β is larger than angle ε. In the embodiment described in FIGS. 6 and 7, the angle ε shown in FIG. 10 is the same as the angle α. Angle α is in FIGS. 6 and 7 described as the maximum angle which the handle 2 can be rotated before abutment between the flange 8 and the inclined surface 10. Given the same conditions as in FIGS. 6 and 7, the maximum angle ε is equal to angle α. However, given that the design of the handle 2 may vary and the connection between the handle 2 and the pushing element 21 may differ in different embodiments of the invention, the angle ε and the angle α may substantially differ from each other.

The latching element 22 is in one embodiment resiliently suspended relative the body 1. The latching element 22 is resiliently suspended towards the latching position. The latching element 22 may be spring suspended. When the latching element 22 is pushed towards the open position by the pushing element 21, the resilient suspension will force the latching element 22 back towards the latching position. The latching element 22 may further be pushed towards the open position by for instance the lock pin 30. When the door onto which the handle arrangement 100 is arranged is closed, the lock pin 30 will push the latching element 22 towards the open position in order to move the latching element 22 into latching engagement with the lock pin 30, i.e. such that the lock pin 30 is arranged in the pin receiving slot 28.

In one embodiment, when the latching element 22 is pushed by the lock pin 30 may the pushing element 21 remain in a non-rotated position. Hence, the latching element 22 may be rotated without the pushing element 21 rotating.

In an alternative embodiment may the latching element 22 and the pushing element 21 be so linked that when the latching element 22 is pushed by the lock pin 30, the pushing element 21 is rotated in the first direction D. Such rotation may further cause the handle gripping portion 3 to be rotated.

As seen in FIGS. 2 and 8, the latching element 22 comprises a groove 24. The groove 24 extends through the latching element 22. At the sliding bolt 26 on the pushing element 21, a push pin 23 may extend into the groove 24. The groove 24 extends such that it enables the same sliding connection between the pushing element 21 and the latching element 22 as the sliding surface 27.

In one embodiment is the sliding surface 27 provided by the groove 24. An edge of the groove 24 then provides the sliding surface 27 in slidable connection with the sliding bolt 26 and/or the push pin 23 on the pushing element 21.

When the push pin 23 is provided on the pushing element 21 and extends into the groove 24, a rotational movement of the latching element 22 not provided by the pushing element 21, but e.g. by the lock pin 30, will cause a rotational movement of the pushing element 21.

As further seen in FIGS. 9 and 10, in one embodiment the pin receiving slot 28 extends along a pin axis E. The pin axis E and the rotational axis B are, when the latching element 22 is in the latching position, arranged along a line R, wherein the line R is substantially perpendicular to a back side surface 14 of the body 1. The back side surface 14 is configured to extend along an outer door surface when the door handle latching arrangement is arranged to a door.

According to one aspect of the invention a handle arrangement 100 is provided comprising a body 1 for arrangement to a door, wherein the body, when arranged to a door, extends substantially in parallel with an outer surface of said door, a latching element 22 for, in a latching position, latching engagement with a lock pin 30 arranged to a corresponding door frame, wherein the latching element 22 is rotatably arranged to the body 1 around a rotational axis B for rotation between an unlatching position and the latching position, wherein the latching element 22 comprises a pin receiving slot 28 for receiving said lock pin 30, the pin receiving slot 28 extending along a pin axis E in parallel with the rotational axis B, wherein the rotational axis B and the pin axis E, when the latching element 22 is in the latching position, are arranged relative each other along a line R which is substantially perpendicular to said extension of the body 1.

By providing the pin axis E and the rotational axis B along a line R which is perpendicular, or substantially perpendicular, to the extension of the body 1, a strong latching arrangement may be provided. When the door handle latching arrangement is arranged to a door, and the latching element 22 is in the latching position in which it receives a lock pin 30 in the pin receiving slot 28, a force trying to open the door, i.e. a force directed in parallel with the line R connecting the pin axis E and the rotational axis B, may not provide a risk of pushing the latching element 22 towards the open position. In a case wherein the line connecting the pin axis E and the rotational axis B provides an angle towards the line R perpendicular to the extension of the body 1, such that the pin receiving slot 28 is located further away from a door frame than the rotational axis B, a force trying to open the door when the latching element 22 is in the latching position receiving the lock pin 30 may cause the latching element 22 to rotate towards the open position and thereby cause an undesired opening of the latching arrangement. This is due to a small partial force occurring directed in the rotational direction D of the latching element 22 towards the open position.

Besides being arranged such that the line R connecting the pin axis E and the rotational axis B is perpendicular to the extension of the body, said line R may be directed with an angle towards an axis perpendicular to the extension of the body, such that the pin receiving slot 28 is located closer to a door frame than the rotational axis B. The partial force occurring when a force trying to open the door is applied may be directed towards the latching position of the latching element 22. Hence, such partial force would make the latching engagement even stronger.

The arrangement of the pin axis E and the rotational axis B relative to each other may alternatively be defined using a door opening axis perpendicular to the rotational axis B which defines a direction in which a door on which the body 1 can be arranged is opened, and wherein the rotational axis B and the pin axis E, when the latching element 22 is in the latching position, are arranged relative each other along a line R which is substantially parallel to said door opening axis.

In one embodiment, the latching element 22 may be hook shaped to form the pin receiving slot.

According to one aspect of the invention a handle arrangement is provided comprising a body 1 for arrangement to a door, a handle 2 for rotational movement relative to the body 1 to open a latching arrangement, an latching element 22 for latching engagement with corresponding lock element 30 arranged on a door frame, wherein the latching element is rotatable relative to the body 1 between an unlatching position and a latching position, and a pushing element 21 in rotationally fixed connection with the handle 2, wherein the pushing element 21 is arranged to, when rotated in a first direction, push the latching element 22 from the latching position to the open position, wherein the pushing element 21 comprises a sliding member 26 in slidable connection to a sliding surface 27 on the latching element 22, such that a rotational movement in the first direction of the pushing element 21 provides an accelerated rotational movement of the latching element 22.

By accelerated rotational movement it may be meant that a rotational movement of the pushing element 21 of a first amount around its rotational axis A may cause a rotational movement of the latching element 22 around its rotational axis B of an amount that is larger than said first amount. As an example, a 15 degrees rotational movement of the pushing element 21 around its rotational axis A may cause a 25 degrees rotational movement of the latching element 22 around its rotational axis B. Both rotational movements of the two elements 21, 22 may be in the same direction around their respective rotational axes A, B.

By providing an accelerated rotational movement of the latching element 22, i.e. the element that provides a latching engagement with a lock element on a corresponding door frame, the handle gripping portion 3 needs to be rotated/raised to a lower degree for providing an unlatching of the latching element. I.e. when opening the door on which the door handle latching arrangement may be arranged, a user may need to lift the handle gripping portion only to a low extent in order to open the door. This may provide a user friendly function of the door handle.

The sliding member 26 on the pushing element 21 may be a sliding bolt 26, and the sliding surface 27 on the latching element 22 may be a sliding plane 27, wherein the sliding bolt 26 may push the latching element 22 such that it abuts the sliding plane 27 and slides along the sliding plane 27 when being rotated in the first direction. When sliding along the sliding surface 27, the sliding member 26 may slide from a first position on the sliding surface 27 towards a second position on the sliding surface 27 when pushing the latching element 22 from the latching position towards the open position. The first position on the sliding surface 27 may be closer to the body 1 than the second position, and/or the first position on the sliding surface 27 may be closer to the rotational axis A of the pushing element 21 than the second position.

By pushing the latching element 22 by abutting the sliding surface 27 of the latching element 22, the pushing element 21 may be in releasable contact with the latching element 22. As a consequence, the latching element may be rotated from the latching position towards the open position, i.e. in the first direction, without being pushed by the pushing element 21, and without the pushing element 21 being moved. Such function may enable a closure of the door, on which the door handle latching arrangement is arranged, such that the latching element 22 becomes in latching engagement with a lock element on the door frame, without the pushing element 21 or the handle gripping portion 3 being moved. Such function may be desired by a user slamming a door to closure without using the handle gripping portion 3, in which situation it is not desired that the handle gripping portion is pushed open by the latching element 22 being rotated to latching engagement with the lock element 30 on the door frame.

The latching element 22 may comprise a groove 24 extending along the sliding surface 27, or constituting the sliding surface 27, and the pushing element 21 may comprise a push pin 23 extending into said groove 24. The pushing element 21 may thereby be connected to the latching element 22 such that the pushing element 21 is configured to both push the latching element 22 when rotated in the first direction, and pull the latching element 22 when rotated in a second direction opposite the first direction. In such embodiment, a rotational movement of the latching element 22 may cause a rotational movement of the pushing element 21 in any direction.

The handle gripping portion 3 and the pushing element 21 may both be rotatable relative to the body 1 around the same rotational axis A.

The pushing element 21 may comprise a first and a second push arm, each in slidable connection with the latching element 22. The groove 24 of the latching element 22 may extend through the latching element 22, such that the push pin may extend from the first push arm to the second push arm through the latching element 22. The first and second push arms may be rotationally fixed relative to each other.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. A handle arrangement (100) for arrangement to a door, said handle arrangement comprising a body (1), a handle (2) rotatably arranged to the body (1) and movable between a closed position and an open position, a latch mechanism (6) for latching a door to a door frame, said latch mechanism (6) being maneuverable between a latching position and an unlatching position by rotating the handle (2) round a first rotational axis (A), a lock arrangement (4) rotationally movable around its central axis (C) and comprising a moveable locking element (7) configured to be moved between an unlocked position and a locked position upon rotation of the lock arrangement (4), wherein the locking element (7) comprises a flange (8) having a bottom surface (81), wherein the handle (2) comprises a stopping surface (9), wherein said flange (8) in the locked position is configured for the bottom surface (81) to abut the stopping surface (9) to prevent rotation of the handle (2) around said first rotational axis (A), and wherein the handle (2) further comprises an inclined surface (10) configured such that when the flange (8) is in an unlocked position, the bottom surface (81) is arranged facing the inclined surface (10) at an angle ($\alpha$) such as to admit the handle (2) to rotate around the first rotational axis (A) in order to bring the latch mechanism (6) in an unlatching position, wherein the rotation of the handle towards the unlatching position is limited by the bottom surface (81) abutting the inclined surface (8).

2. Handle arrangement (100) according to claim 1, wherein the lock arrangement (4) is rotatable around a central axis (C) perpendicular to the first rotational axis (A).

3. Handle arrangement (100) according to claim 1, wherein the handle (2) comprises a gripping portion (3), and wherein the stopping surface (9) is arranged between the gripping portion (3) and the first rotational axis (A).

4. Handle arrangement (100) according to claim 3, wherein the body (1) comprises a gripping portion receiving area (5) in which the gripping portion (3) is located in a closed position.

5. Handle arrangement (100) according to claim 4, wherein the body (1) comprises an internal lock cavity (51) adjacently located to the gripping portion receiving area (5), in which internal lock cavity (51) the locking element (7) and the stopping surface (9) are located.

6. Handle arrangement (100) according to claim 5, wherein the gripping portion receiving area (5) and the internal lock cavity (51) are in direct fluid connection with each other.

7. Handle arrangement (100) according to claim 5, wherein the handle (2) further comprises a visor (32), attached to the gripping part (3) and configured to, in a closed position, cover the lock arrangement (4) in the internal lock cavity (51).

8. Handle arrangement (100) according to claim 5, wherein the first rotational axis (A) extends across said internal lock cavity (51).

9. Handle arrangement (100) according claim 1, wherein the lock arrangement (4) is located along a longitudinal centre line (X) of the body (1) between the gripping portion (3) and the latching mechanism (6).

* * * * *